US005103850A

United States Patent [19]

Davis

[11] Patent Number: 5,103,850

[45] Date of Patent: Apr. 14, 1992

[54] RADIAL CRUTCH TIP ASSEMBLY

[75] Inventor: Richard C. Davis, Palm Harbor, Fla.

[73] Assignee: Code Blue Medical Corporation, Clearwater, Fla.

[21] Appl. No.: 680,080

[22] Filed: Apr. 3, 1991

[51] Int. Cl.[5] ..... A45B 1/00

[52] U.S. Cl. ..... 135/84; 135/77

[58] Field of Search ..... 135/77, 84

[56] References Cited

U.S. PATENT DOCUMENTS

| | | | |
|---|---|---|---|
| 267,680 | 11/1882 | Crandall . | |
| 1,003,103 | 9/1911 | Harding . | |
| 1,323,629 | 12/1919 | Hall . | |
| 1,621,255 | 3/1927 | Hunter . | |
| 2,429,409 | 10/1947 | Eidman | 135/51 |
| 2,910,995 | 11/1959 | Jacuzzi | 135/62 |
| 4,098,283 | 7/1978 | Tritle | 135/77 |
| 4,493,334 | 1/1985 | Semanchik | 135/84 |
| 4,899,771 | 2/1990 | Wilkinson | 135/84 |

FOREIGN PATENT DOCUMENTS

| | | | |
|---|---|---|---|
| 371075 | 1/1907 | France | 135/84 |
| 659233 | 6/1929 | France | 135/84 |
| 908795 | 4/1946 | France | 135/84 |
| 645650 | 2/1979 | U.S.S.R. | 135/84 |
| 22171 | of 1914 | United Kingdom . | |

*Primary Examiner*—Henry E. Raduazo

*Attorney, Agent, or Firm*—Griffin Branigan & Butler

[57] ABSTRACT

A crutch tip assembly (12) comprises a solid base (14) having substantially vertical side surfaces (18, 20, 54, 56) and outwardly, downwardly tapered front and rear surfaces (**22, 24, 51*a*, 51*b*) with convex bottom surface (26, 52) forming an approximate arc elongated in a direction approximately parallel to the side surfaces. A laterally outwardly protruding lip (28, 50) is positioned adjacent the bottom surface near bottom edges of the side, front and rear surfaces on which a resilient boot (16, 70) having the shape of a rocker is mounted. The resilient boot defines a mounting cavity (36, 72) for snugly receiving the solid-base bottom surface and the lip for holding the boot on the solid base. An elongated, centered, arch-shaped groove (38, 74) extends along a bottom surface of the boot. The solid base is attached to a single support 33 at a lower end of a crutch frame 34 by means of a tongue (30, 68) and groove (32**) joint and alternately an adhesive or other affixing means.

7 Claims, 2 Drawing Sheets

RADIAL CRUTCH TIP ASSEMBLY

BACKGROUND OF THE INVENTION

This invention relates generally to the art of crutches, walkers, and canes and more particularly to crutch, walker or cane tip assemblies.

A problem encountered by many when using ambulatory assistance devices such as crutches is that when the crutches are extended at angles forwardly or rearwardly their tips do not always get adequate traction with floor surfaces, thereby slipping away from users. This is not only annoying, but can be dangerous to the users. It is therefore an object of this invention to provide a crutch tip which achieves increased traction with floor surfaces when a crutch is angled outwardly in front of or behind a user.

It has been suggested to place a rocker at a tip end of a crutch as is taught in Soviet Union patent document 0645650 and U.S. Pat. No. 267,680 to Crandall and U.S. Pat. No. 1,621,255 to Hunter. However, the crutches of these patents are specially built so as to include the rockers, and the rockers themselves are extremely complicated, difficult to manufacture, and appear to be quite expensive. Thus, it is an object of this invention to provide a crutch tip assembly having an elongated, substantially arc-shaped, lower surface which can be mounted on a standard crutch and which is itself relatively uncomplicated and inexpensive to construct and use. Furthermore, it is an additional object of this invention to provide an easily removable, inexpensive boot for such a crutch tip assembly which can be easily replaced once worn out.

SUMMARY

According to principles of this invention, a crutch tip assembly comprises an elongated solid base having outwardly, downwardly, tapered front and rear surfaces and more nearly vertical side surfaces, with a convex bottom surface forming an approximate arc which is elongated in a direction approximately parallel to the side surfaces, with the solid base including a lip protruding laterally outwardly adjacent the bottom surface near bottom edges of the side, front and rear surfaces. A resilient replaceable boot having the shape of a rocker has a mounting cavity for snugly receiving the bottom surface and the lip for holding the boot on the solid base. The boot includes an elongated arc-shaped groove surface extending along its bottom surface so that the boot bottom surface defines a treaded traction surface coincident with traction shoulders on each side thereof.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
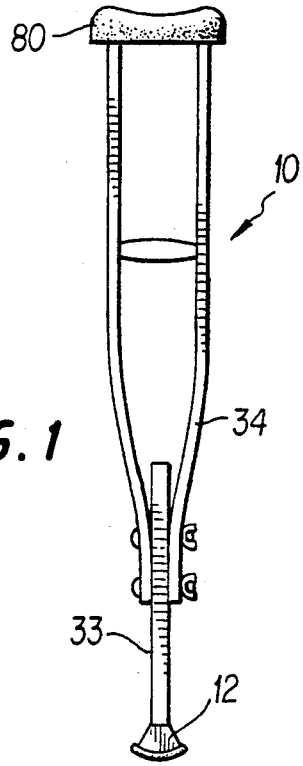
FIG. 1 is a side elevational view of a crutch having a simplified radial crutch tip assembly of this invention mounted thereon.
Figure 2:
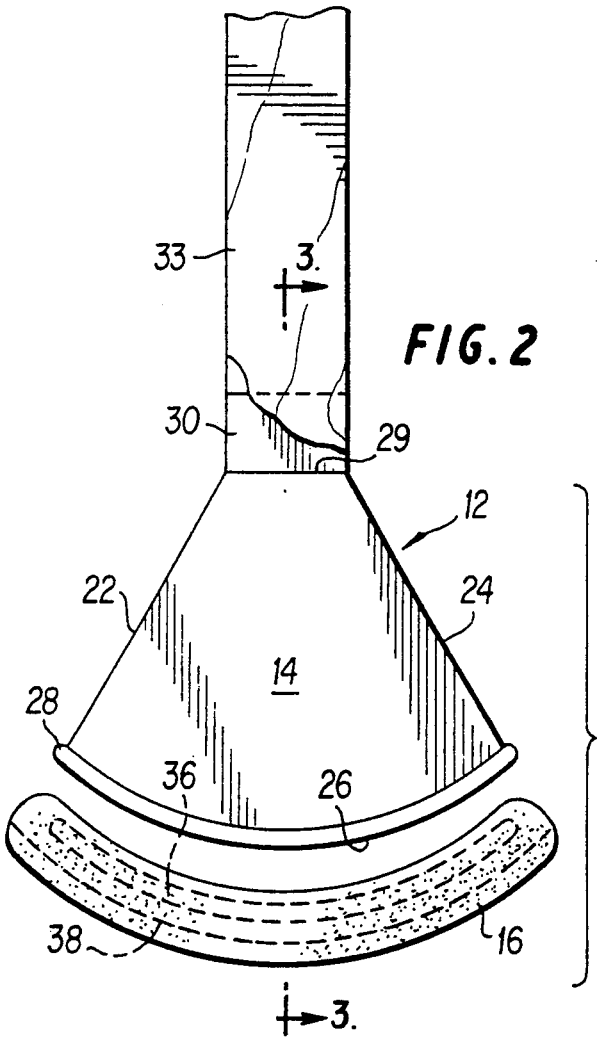
FIG. 2 is an enlarged, exploded, partially cutaway, view of the tip of the crutch of FIG. 1.
Figure 3:
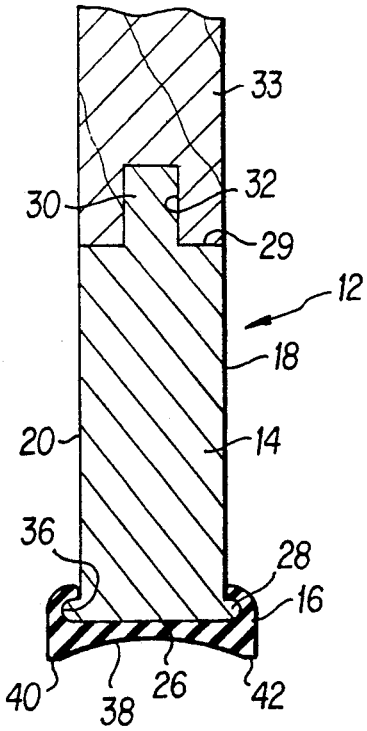
FIG. 3 is a cross sectional view taken on line 3—3 in FIG. 2, with the parts thereof not being exploded but rather assembled.
Figure 4:
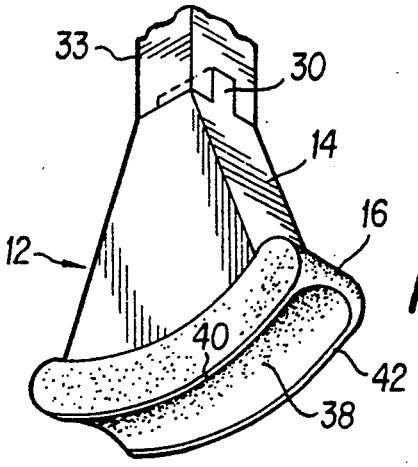
FIG. 4 an isometric view of the tip of FIGS. 2 and 3 when assembled.
Figure 5:
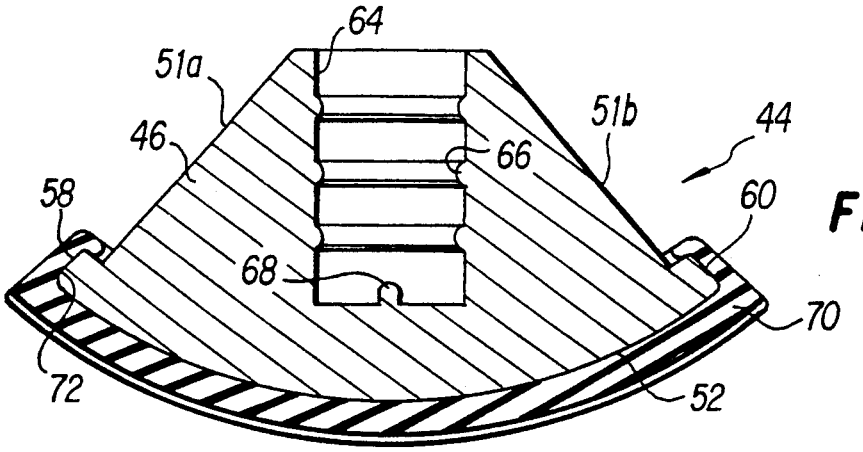
FIG. 5 is a cross sectional view of a preferred-embodiment radial crutch tip assembly of this invention.
Figure 6:
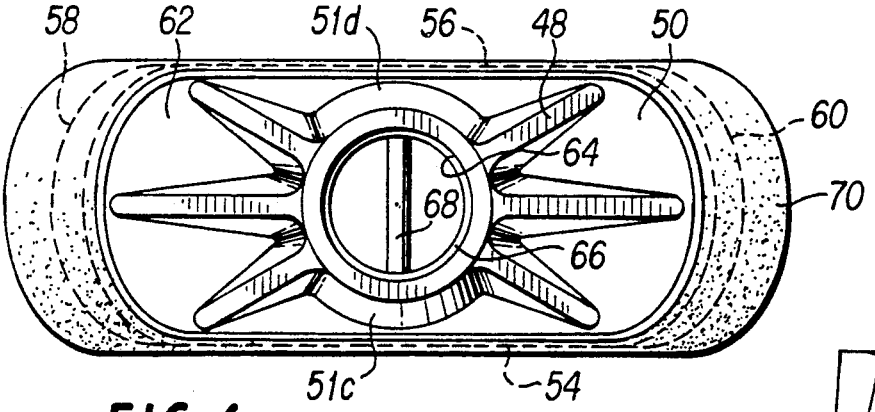
FIG. 6 is a top view of the radial crutch tip assembly of FIG. 5.
Figure 7:
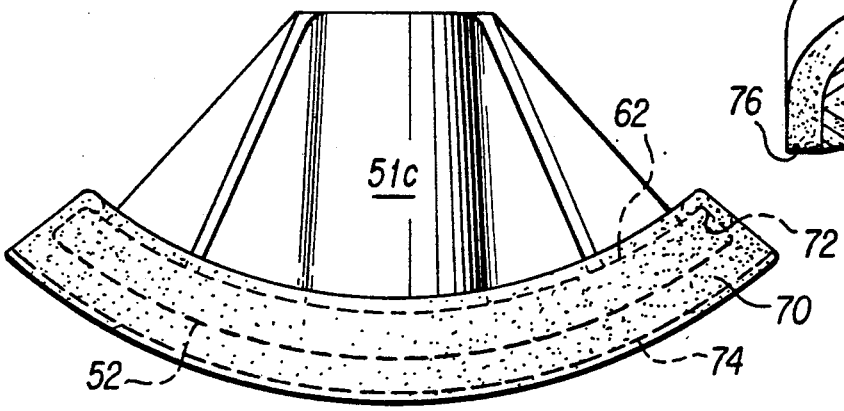
FIG. 7 is a side view of the crutch tip assembly of FIG. 5.
Figure 8:
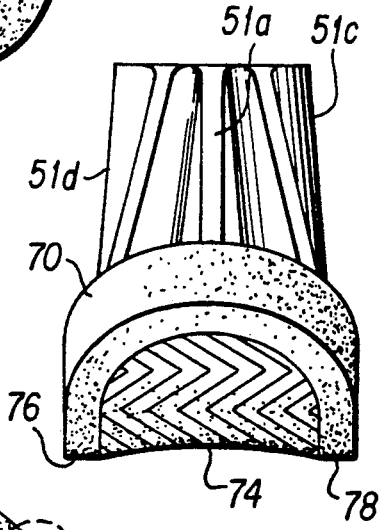
FIG. 8 is a front end view of the crutch tip assembly of FIG. 5.

A standard crutch 10 has a radial crutch tip assembly 12 at a lower end tip thereof. A simplified embodiment of the radial crutch tip assembly 12 is depicted in FIGS. 2, 3 and 4. In this simplified embodiment, the crutch tip assembly 12 comprises a solid base 14 and a resilient boot 16. The solid base 14 is molded as one piece of a very strong yet lightweight resinous plastic such as a polycarbonate sold under the Dupont trademark LEXAN. The solid base 14, in this simplified embodiment, has flat, approximately, parallel first and second side surfaces 18 and 20, outwardly and downwardly tapered front and rear surfaces 22 and 24 and a convex bottom surface 26 forming an arc. It is the arc-shape of this convex bottom surface 26 from which the radial crutch tip assembly gets its name inasmuch as portions of the solid base 14 extending between the front and rear surfaces 22 and 24 form radii, or spokes, for supporting the arc-shaped convex bottom surface 26. The solid base 14 also includes a surrounding, peripheral, laterally-outwardly protruding lip 28 adjacent bottom edges of the first and second side surfaces 18 and 20 and the front and rear surfaces 22 and 24. A top surface 29 of the solid base 14 includes an attaching tongue 30 which is insertable into a groove 32 in a bottom tip end of a single support 33 of a crutch frame 34. In this regard, the top surface 29 of the solid base 14, including the attaching tongue 30, are glued to the lower end tip of the crutch frame 34.

The resilient boot 16 is normally of a hard rubber and has the shape of an elongated rocker. The resilient boot 16 defines a mounting cavity 36 in a top surface thereof and an elongated, arch-shaped-in-cross-section, groove 38 in a lower surface thereof. The elongated arch-shaped groove 38 is so formed that there are traction shoulders 40 and 42 extending along each side of the treaded bottom surface of the elongated resilient boot 16 for contacting a floor surface when the crutch 10 is used.

FIGS. 5–8 disclose a preferred embodiment of a radial crutch-tip assembly 44 of this invention in which a solid base 46, also molded as one piece of a polycarbonate resinous plastic, is not as block shaped as is the crutch tip assembly 12 of FIGS. 1–4 but rather is formed of supporting super-structure ribs 48 and a lower lip 50. This configuration maintains the strength of the base 46 while reducing its weight. Angled outer edges **51*a* and 51*b* of front and rear ribs partially define front and rear surfaces of the solid base 46 while more vertical outer edges 51*c* and 51*d* of side ribs partially define side surfaces thereof. The lower lip 50 basically forms part of a rocker having a bottom base surface 52, side lip surfaces 54 and 56, front and rear lip surfaces 58** and 60 and a top lip surface 62. The super-structure ribs 48 are molded on the top lip surface 62 as one piece therewith to extend thereabove and to define a crutch-frame bore 64 for receiving a lower end tip of a single support 33 of a crutch frame 34. The crutch-frame bore 64 has annular spines 66 therealong for somewhat resiliently allowing the single support 33 of the crutch frame 34 to pass into the crutch-frame bore 64 and to thereafter strongly grip an outer surface of the crutch frame 34. Again, a tongue 68 is formed in a bottom of the crutch-frame bore 64 for cooperatinq with a groove in a lower end tip of the single support 33 of the crutch frame 34, but this tongue 68 extends perpendicular to a direction of ambulation. Again, the single support 33 of the crutch frame 34 is adhered or otherwise affixed to the tongue 68 as well as other surfaces forming the crutch-frame bore 64.

The embodiment of FIGS. 5–8 also includes an easily replaceable resilient boot 70 having a mounting cavity 72 in a top surface thereof for receiving an outer periphery formed by the side, front and rear lip surfaces 54, 56, 58 and 60 for thereby holding the resilient boot 70 on the bottom surface 52 of the solid base 46. The resilient boot 70 also includes an arch-shaped groove 74 running longitudinally along a bottom surface of the resilient boot 70 so as to respectively form traction shoulders 76 and 78 on opposite sides of the bottom surface of the resilient boot 70, as well as a treaded undersurface 80 to provide maximum traction.

It should be understood that the preferred embodiment of FIGS. 5–8 has a weight advantage over the simplified embodiment of FIGS. 2–4, in that it is lighter since the super-structure ribs 48 do not have as much weight as the block-formed super structure of the device of FIGS. 2–4.

In operation, a solid base of a radial crutch tip assembly of this invention is mounted to a lower tip end of the single support 33 of the standard crutch frame 34 in the manner shown in FIGS. 3 and 4, by inserting the lower end of the crutch frame 34 into a crutch-frame bore 64 as shown in FIGS. 5–8, or in some other equivalent manner. Again, an adhesive is normally used. Alternatively, screws or other fasteners may be used to affix the support 33 to the base 14. The tongue and groove connection prevent rotation of the crutch tip assembly and hold it aligned in the direction of ambulation.

Thereafter, the flexible boot, such as the resilient boot 16 of the simplified embodiment of FIGS. 2–4, the resilient boot 70 of the preferred embodiment of FIGS. 5–8, or some other equivalent boot, is placed about the lip for holding the resilient boot on the bottom surface of the solid base. The resilient boot is so held on the solid base that its arch-shaped groove 38, 74 or the like, runs parallel to elongation of the arch-shaped convex bottom surface 26, 52, or the like, of the solid base.

When a user uses the crutch 10, an under-arm support 80 thereof is approximately aligned with the axis of elongation of the arch shaped groove 38, 74 so that when a user extends the crutch 10 on an angle in front of or behind him to contact a floor surface, the arch-shaped traction shoulders 40, 42, 76, 78, or the like, contact the floor surface and roll thereon as the user ambulates forwardly on the crutch, with the arch-shaped shoulders rolling across the floor surface as the crutch is rotated. As the user applies weight to the crutch 10, the traction shoulders, 40, 42, 76, 78 are urged downwardly and outwardly so that additional treaded undersurface of the arch-shaped groove 38, 74 makes contact with the floor surface, thereby increasing the size of the contact surface of the crutch tip assembly 12, 44 with the floor surface; and the treaded surface further inhibits slippage.

It will be appreciated by those of ordinary skill in the art that the crutch tip assemblies of this invention are extremely uncomplicated and easy to manufacture inasmuch as they comprise only two pieces, a solid base and a resilient boot. The resilient boot of this invention can be easily replaced by even physically handicapped users when it wears out, without requiring a major repair of a crutch.

The crutch tip assembly of this invention provides increased traction of a lower tip of a crutch with a floor surface, not only making it easier for a user to ambulate with the crutch but making it safer as well.

Yet another benefit of this invention is that it can be used with a normal crutch, that is, a crutch having only a single crutch frame support 33 forming a lower end tip thereof.

While the invention has been particularly shown and described with reference to a preferred embodiment, it will be understood by those skilled in the art that various changes in form and detail may be made therein without departing from the spirit and scope of the invention. For example, a convex bottom surface 26 or 52 of the solid base can be straight or convexed in cross section, perpendicular to the axis of elongation of the bottom base surface, or it can also have an elongated concaved groove therein so that it is arch-shaped in the same manner as are the arch-shaped grooves 38 and 74. The crutch tip assembly of this invention can be used with a standard wooden, aluminum, or some-other-material, crutch. It may be possible to eliminate the tongue and groove connection in the preferred embodiment of FIGS. 5–8, although this connection is helpful to maintain proper angular position of the crutch tip assembly on the crutch. Alternately, sidewall keys fitting into adjacent slots or other base-orienting designs may be similarly used to maintain the angular alignment of the base.

The embodiments of the invention in which an exclusive property or privilege are claimed or defined are as follows:

I claim:

1. A crutch tip assembly comprising:

a solid base having outwardly, downwardly tapered front and rear surfaces and more nearly vertical side surfaces, with a convex bottom surface forming an approximate arc which curves in a direction of elongation, said solid base further including a lip protruding laterally outwardly adjacent said bottom surface near bottom edges of said side, front and rear surfaces;

a resilient boot having the shape of a rocker, said resilient boot defining a mounting cavity for snugly receiving said bottom surface and said lip for holding said boot on said solid base; and an attaching means at a top surface of said solid base for attaching said solid base to a lower end of a crutch;

wherein an elongated arch groove extends along a bottom surface of said resilient boot.

2. A crutch tip assembly as in claim 1 wherein said solid base is constructed of resinous plastic and said boot is constructed of rubber.

3. A crutch tip assembly as in claim 2 wherein said attaching means is for attaching to only a single crutch frame support.

4. A crutch tip assembly as in claim 3 wherein said attaching means includes a tongue for fitting into a groove of said single crutch frame support.

5. A crutch tip assembly as in claim 1 wherein the underside of said groove is treaded.

6. A crutch tip assembly as in claim 1 wherein said attaching means is for attaching only to a single crutch frame support.

7. A crutch tip assembly as in claim 1 wherein said attaching means includes a tongue for fitting into a groove of said single crutch frame support.

* * * * *